US009445201B2

(12) United States Patent
Hyde et al.

(10) Patent No.: US 9,445,201 B2
(45) Date of Patent: Sep. 13, 2016

(54) INVERTED DUAL COIL TRANSDUCER

(71) Applicant: Harman International Industries, Inc., Stamford, CT (US)

(72) Inventors: Ralph Hyde, Santa Clarita, CA (US); Alexander Salvatti, Morgan Hill, CA (US); Alexander Voishvillo, Simi Valley, CA (US)

(73) Assignee: Harman International Industries, Inc., Stamford, CT (US)

( * ) Notice: Subject to any disclaimer, the term of this patent is extended or adjusted under 35 U.S.C. 154(b) by 127 days.

(21) Appl. No.: 14/086,552

(22) Filed: Nov. 21, 2013

(65) Prior Publication Data

US 2015/0139478 A1 May 21, 2015

(51) Int. Cl.

| | |
|---|---|
| ***H04R 9/02*** | (2006.01) |
| ***H04R 1/00*** | (2006.01) |
| ***H04R 9/00*** | (2006.01) |
| ***H04R 9/06*** | (2006.01) |

(52) U.S. Cl.

CPC ..... *H04R 9/022* (2013.01); *H04R 1/00* (2013.01); *H04R 9/00* (2013.01); *H04R 9/06* (2013.01); *H04R 9/025* (2013.01); *H04R 2209/041* (2013.01)

(58) Field of Classification Search

CPC . H04R 2209/041; H04R 9/022; H04R 9/025
USPC ..... 381/416
See application file for complete search history.

(56) References Cited

U.S. PATENT DOCUMENTS

| | | | | |
|---|---|---|---|---|
| 2,551,447 A | | 5/1951 | Marquis | |
| 3,250,862 A | | 5/1966 | Rollins | |
| 4,737,992 A | | 4/1988 | Latham-Brown et al. | |
| 4,783,824 A | * | 11/1988 | Kobayashi | H04R 9/025 381/402 |
| 5,040,221 A | | 8/1991 | Edwards et al. | |
| 5,625,701 A | * | 4/1997 | Scanlan | H04R 7/16 381/403 |
| 5,740,265 A | * | 4/1998 | Shirakawa | H04R 9/046 381/386 |
| 5,802,191 A | | 9/1998 | Guenther | |
| 5,828,767 A | * | 10/1998 | Button | H04R 3/002 381/400 |

(Continued)

FOREIGN PATENT DOCUMENTS

| | | |
|---|---|---|
| DE | 4225854 A1 | 2/1994 |
| DE | 19534342 C2 | 2/2000 |

(Continued)

OTHER PUBLICATIONS

Harman Becker Automotive Systems, "Speaker 250mm Toyota 920L Rear Deck Subwoofer", 1 page, Jun. 2, 2011.

(Continued)

*Primary Examiner* — Matthew Eason
(74) *Attorney, Agent, or Firm* — Brooks Kushman P.C.

(57) ABSTRACT

A dual coil transducer is provided that has a low profile construction. The transducer includes a voice coil disposed around a central region of the transducer, a diaphragm with flexible suspension extending generally outwardly from the central region and including an inner edge attached to the voice coil, where the diaphragm includes a concave surface, and at least one magnet assembly disposed forward of the concave surface, where the at least one magnet assembly defines at least two magnetic gaps disposed about the central region. The transducer will usually be mounted with the motor outside of the loudspeaker enclosure for best heat dissipation.

26 Claims, 8 Drawing Sheets

(56) References Cited

U.S. PATENT DOCUMENTS

| | | | | |
|---|---|---|---|---|
| 6,671,385 | B2 * | 12/2003 | Suzuki | H04R 9/06 381/401 |
| 6,940,992 | B2 * | 9/2005 | Stiles | H04R 9/025 381/412 |
| 7,006,654 | B2 * | 2/2006 | Stiles | H04R 9/063 381/400 |
| 7,012,345 | B2 * | 3/2006 | Moro | H04R 9/025 310/12.01 |
| 7,016,514 | B2 * | 3/2006 | White | H04R 9/06 381/397 |
| 7,382,893 | B2 * | 6/2008 | Baeten | H04R 9/06 381/412 |
| 7,831,059 | B1 * | 11/2010 | Sahyoun | H04R 9/022 381/396 |
| 8,842,873 | B2 * | 9/2014 | Bullimore | H04R 7/26 381/396 |
| 2004/0052397 | A1 * | 3/2004 | Aronson | H04R 9/022 381/397 |
| 2005/0190945 | A1 * | 9/2005 | Calderwood | H04R 9/025 381/412 |
| 2005/0271237 | A1 * | 12/2005 | Jeong | H04R 9/063 381/396 |
| 2006/0078151 | A1 * | 4/2006 | Kemmerer | H04R 9/022 381/397 |
| 2007/0230737 | A1 * | 10/2007 | Hyde | H04R 9/063 381/421 |
| 2008/0304694 | A1 * | 12/2008 | Hayashi | H04R 9/022 381/397 |
| 2009/0016563 | A1 * | 1/2009 | Wei | H04R 9/02 381/430 |
| 2015/0139478 | A1 * | 5/2015 | Hyde | H04R 9/00 381/401 |

FOREIGN PATENT DOCUMENTS

| | | | |
|---|---|---|---|
| EP | 0624049 | A2 | 11/1994 |
| EP | 0806883 | A2 | 11/1997 |
| EP | 0642291 | B1 | 2/2002 |
| EP | 1231817 | A2 | 8/2002 |
| EP | 1532840 | A1 | 5/2005 |
| EP | 1659824 | A2 | 5/2006 |
| EP | 2373056 | A1 | 10/2011 |
| GB | 2360899 | A | 10/2001 |
| GB | 2375454 | A | 11/2002 |
| JP | 2003299185 | A | 10/2003 |
| WO | 2004017674 | A1 | 2/2004 |

OTHER PUBLICATIONS

Harman Becker Automotive Systems, "Speaker 250mm Toyota 920L Rear Deck Subwoofer", 1 page, Oct. 10, 2012.

European Patent Office, Extended Search Report for corresponding European Patent Application No. 14191814.4 mailed Jun. 9, 2015.

* cited by examiner

INVERTED DUAL COIL TRANSDUCER

TECHNICAL FIELD

The disclosure generally relates to an audio transducer, and in particular, to the configuration of a low profile, light weight, high power audio transducer.

BACKGROUND

An electrodynamic transducer may be utilized as a loudspeaker or as a component in a loudspeaker system to transform electrical signals into acoustical signals. The basic designs and components of various types of electrodynamic transducers are well-known.

An electrodynamic transducer typically includes mechanical, electromechanical, and magnetic elements to effect the conversion of an electrical input into an acoustical output. For example, the transducer typically includes a frame, a magnetic motor assembly that provides a magnetic field across an air gap, a voice coil, a diaphragm having an outer perimeter and an apex, and a suspension system coupled between the outer perimeter of the diaphragm and the outer perimeter of the frame. The voice coil, supported by a former, is coupled to the apex of the diaphragm so that the electrical current that flows through the voice coil causes the voice coil to move in the air gap and also causes the diaphragm to move.

The motor assembly and voice coil cooperatively function as an electromagnetic transducer (also referred to as simply a transducer, loudspeaker, or driver). The motor assembly typically includes a magnet (typically a permanent magnet) and associated ferromagnetic components-such as pole pieces, plates, rings, and the like-arranged with cylindrical or annular symmetry about a central axis. However, any device that creates a static magnetic field may be used, including field coil motors with no permanent magnets. Moreover, other magnet arrangements may be used, such as square, race track or other asymmetric configurations.

Taking the annular configuration as a typical example, the motor assembly establishes a magnetic circuit in which most of the magnetic flux is directed into an annular (circular or ring-shaped) air gap (or "magnetic gap"), with the lines of magnetic flux having a significant radial component relative to the axis of symmetry. The voice coil typically is formed by an electrically conductive wire cylindrically wound for a number of turns around the lower portion of the voice coil former, while the upper part of the voice coil former is attached to the diaphragm. The coil former and the attached voice coil are inserted into the air gap of the magnetic assembly such that the voice coil is exposed to the static (fixed-polarity) magnetic field established by the magnetic motor assembly. The voice coil may be connected to an audio amplifier or other source of electrical signals that are to be converted into sound waves.

In a conventional construction, the diaphragm of the transducer (also called "a cone" because of its shape) is formed as a cone that is substantially greater in diameter than the voice coil. In this type of construction, the diaphragm includes a flexible or compliant material that is responsive to a vibrational input. The diaphragm is suspended by one or more supporting but compliant suspension members such that the flexible portion of the diaphragm is permitted to move. In common constructions, the suspension members may include an outer suspension member known as a "surround." The surround is connected to the diaphragm's outer edge and extends outward from the diaphragm to connect the diaphragm to the frame. The supporting elements may also include an inner suspension known as "spider." The spider is typically connected to the voice coil and extends from the voice coil to a lower portion of the frame; thus, connecting the voice coil to the frame. In this way, the diaphragm is mechanically referenced to the voice coil, typically by being connected directly to the former on which the voice coil is supported.

In operation, electrical signals are transmitted as an alternating current (AC) through the voice coil in a direction substantially perpendicular to the direction of the lines of magnetic flux produced by the magnets. The alternating current interacts with the constant magnetic field in the magnetic air gap. The interaction results in a Laplace force. This force is expressed as a product of the magnetic flux density, overall length of the voice coil's turns linked to the magnetic flux, and the value of the electrical current running through the voice coil. Due to the Laplace force acting on the coil wire positioned in the permanent magnetic field, the alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level, and are a function of the characteristics of the electrical signals supplied to the voice coil.

Because the material of the voice coil has an electrical resistance, some of the electrical energy flowing through the voice coil is converted to heat energy instead of sound energy. The heat emitted from the voice coil may be transferred to other operative components of the loudspeaker, such as the magnetic assembly and coil former. The generation of resistive heat is disadvantageous for several reasons. First, the conversion of electrical energy to heat energy constitutes a loss in the efficiency of the transducer in performing its intended purpose—that of converting the electrical energy to mechanical energy utilized to produce acoustic signals. Second, excessive heat may damage the components of the loudspeaker and/or degrade the adhesives often employed to attach various components together, and may even cause the loudspeaker to cease functioning. For instance, the materials of certain components themselves, as well as adhesives and electrical interconnects (e.g., contacts, soldered interfaces) may melt, become fouled, or otherwise degraded.

As additional examples, the voice coil may become detached from the coil former and consequently fall out of proper position relative to other components of the driver, which adversely affects the proper electromagnetic coupling between the voice coil and the magnet assembly and the mechanical coupling between the voice coil and the diaphragm. Also, excessive heat will cause certain magnets to become demagnetized; for example, different grades of neodymium (Nd) magnets will demagnetize at temperatures between about 80° C. and 200° C. Thus, the generation of heat limits the power handling capacity and distortion-free sound volume of loudspeakers as well as their efficiency as electro-acoustical transducers. Such problems are exacerbated when one considers that electrical resistance through a voice coil increases with increasing temperature. That is, the hotter the wire of the voice coil becomes, the higher its electrical resistance becomes and the more heat it generates.

The most common form of a loudspeaker uses a single voice coil winding in a single magnetic gap. However, loudspeaker performance may be enhanced by using a multiple coil/multiple gap design.

A multi-coil transducer may include two or more separate windings axially spaced apart from each other to form two or more coils, although the same wire may be employed to form the coils. The multiple voice coils are usually electrically connected together either on the coil itself or on the outside of the loudspeaker so that the coils work together to move the diaphragm. As both coils provide forces for driving the diaphragm, the power output of the loudspeaker may be increased without significantly increasing size and mass. The most common implementation of the multiple coil loudspeaker uses two voice coils and two magnetic gaps, however, additional voice coils may serve other purposes besides driving the cone, such as limiting excessive excursion or providing a sense signal that indicates coil velocity or position or other functions.

Many multi-coil/multi-gap designs are able to produce more power output per transducer mass and dissipate more heat than conventional single-coil designs. For example, a dual-coil design provides more coil surface area compared with many single-coil configurations, and, thus, ostensibly is capable of dissipating a greater amount of heat at a greater rate of heat transfer. A dual-coil design that doubles the surface area and number of turns of the coil winding may increase (e.g., nearly double) the capacity of the coil to dissipate heat.

While the multiple coil/multiple gap construction has several advantages over single gap designs including higher power handling, reduced distortion, reduced inductance, and extended frequency response, there are at least three particular disadvantages with dual coil/dual gap speakers. First, insofar as a desired advantage of the dual-coil driver is its ability to operate at a greater power output, so operating the dual-coil transducer at the higher power output concomitantly causes the dual-coil transducer to generate more heat. Hence, the improved heat dissipation inherent in the dual-coil design may be offset by the greater generation of heat. There can be problems with overheated magnets due to the compact motor and the proximity of the magnets to the heat-generating voice coils. For example, as compared to single-coil transducers, adequate heat dissipation in many dual-coil transducers, and more generally multiple-coil transducers, continues to be a problem due to the longer thermal paths that must be traversed between the heat source (primarily the voice coil) and the ambient environment.

Second, the longer dual voice coil and motor structure add to the overall depth of the loudspeaker and this can limit the usability in applications with limited available space.

Third, the longer dual voice coil is cantilevered at the extreme back of the loudspeaker, far removed from the suspension elements. In this position the voice coil is prone to wobble or lash radially in the magnetic gap, possibly striking the magnet structure. An additional drawback of having a deeper profile requires more space inside the speaker enclosure.

Accordingly, a need therefore exists for a compact to multiple voice coil/multiple gap transducer construction providing increased power handling and means for rapidly removing significant amounts of heat from electrically conductive coil structures and magnetic structures during the operation of transducers and transducer-containing devices such as loudspeakers and the like.

SUMMARY

A dual coil electromagnetic transducer is provided that has a low profile construction, increased thermal power handling capability, and improved dynamic stability. In one implementation, the transducer may include a voice coil disposed around a central region of the transducer and a movable diaphragm (having a flexible suspension portion) extending generally outwardly from the central region. The diaphragm includes an inner edge attached to the voice coil and a concave surface. The transducer also includes at least one magnet assembly disposed forward of the concave surface, where the at least one magnet assembly defines at least two magnetic gaps disposed about the central region.

In another implementation, the transducer may include a basket disposed about a central axis, a diaphragm including a flexible diaphragm portion reciprocatively moveable relative to the central axis, where the diaphragm is coupled to the basket to define an enclosure between a back surface of the diaphragm and the basket, at least one magnet assembly disposed outside of the enclosure and axially spaced from the diaphragm, the magnetic assembly having at least a first and second magnetic gap annularly disposed about the central axis, and an electrically conductive coil mechanically communicating with the diaphragm, the coil including at least a first coil and a second coil axially spaced from each other where the first coil is at least partially disposed in the first magnetic gap and the second coil is at least partially disposed in the second magnetic gap.

In yet another implementation, the transducer may include a center hub disposed about a central axis of the transducer, at least one magnet assembly coupled to the center hub, the at least one magnet assembly defines at least two magnetic gaps annularly disposed about the central axis, a voice coil disposed about the at least one magnet assembly, the voice coil being positioned within the at least two magnetic gaps, and a diaphragm extending generally outwardly from the central region and including an inner edge attached to the voice coil. The diaphragm may be coupled with a basket disposed about the central region where the basket forms an enclosure with the back surface of the diaphragm. In this implementation, the at least one magnet assembly is disposed outside of the enclosure to enable heat dissipation from the at least one magnet assembly to the ambient air.

A method for cooling an electromagnetic transducer is also provided. The method includes providing the transducer with at least one magnet assembly having a port formed through its center, a coil including at least a first coil and a second coil axially spaced from each other where the first coil is at least partially disposed in a first magnetic gap and the second coil is at least partially disposed in a second magnetic gap, and a former about which the coil is wound, where the former includes a closed end cap positioned below the at least one magnet assembly, and passing electrical signals through the first coil and second coil to cause the former to oscillate. As the former oscillates, the end cap pumps hot air within a space between the at least one magnet assembly and the end cap through the port to the ambient air to cool the transducer by convection.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE DRAWINGS

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
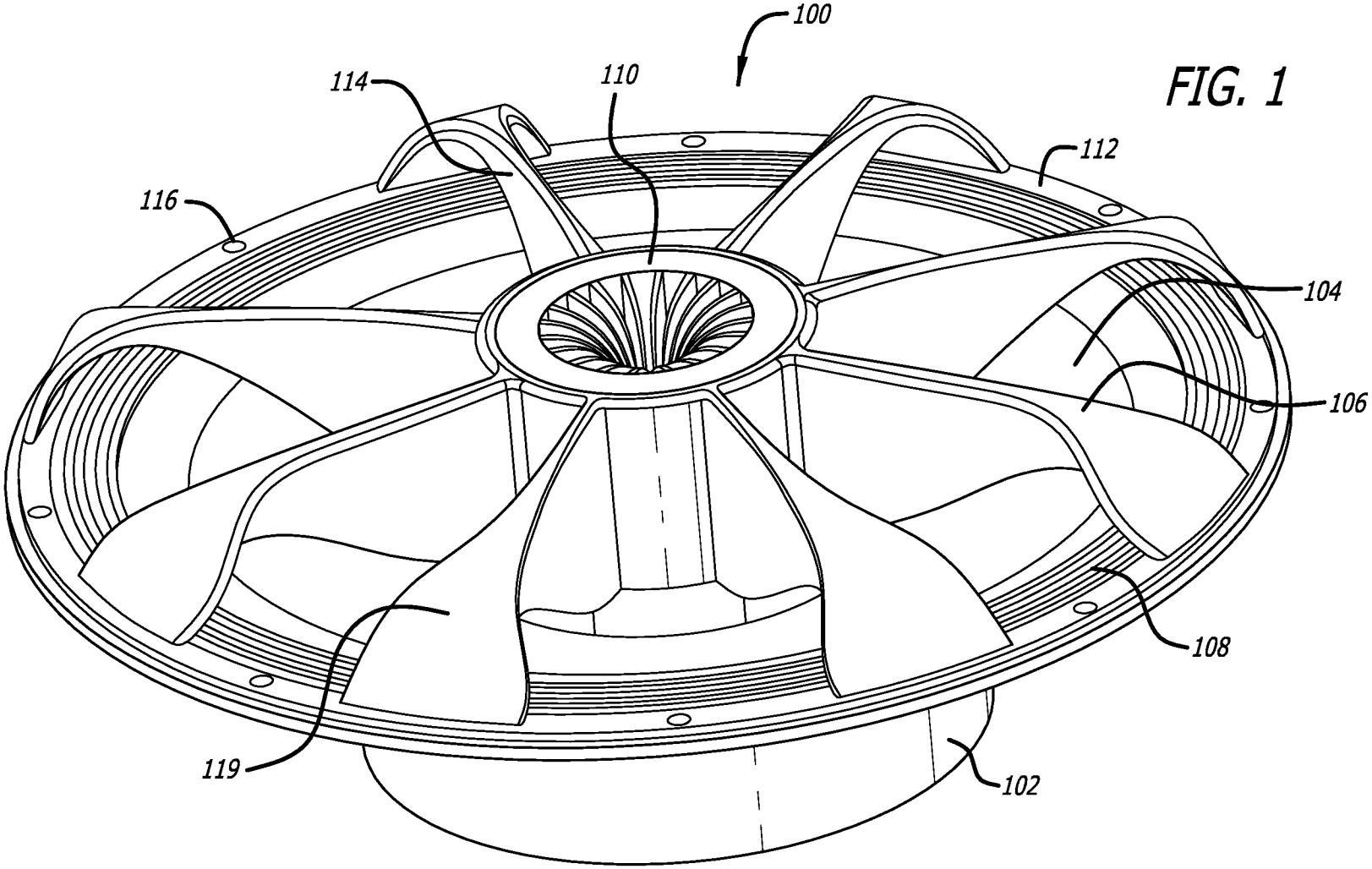
FIG. 1 illustrates a perspective view of one example of an implementation of a transducer of the present disclosure.

FIGS. 1-8 illustrate various implementations of an electromagnetic transducer (i.e., loudspeaker driver) of the present disclosure. In particular, FIG. 1 illustrates a perspective view of one example of an implementation of a transducer 100 of the present disclosure. The transducer 100 may include a basket or rear frame 102, a diaphragm 104, a magnet assembly 202 (FIG. 2), a voice coil 204 (FIG. 2), a front frame 106, and a suspension system including a surround 108 and a spider element 206. While most commonly of a circular shape, the transducer 100 may incorporate diaphragms of the constructions such as triangular, square, or any other suitable construction.

Figure 2:
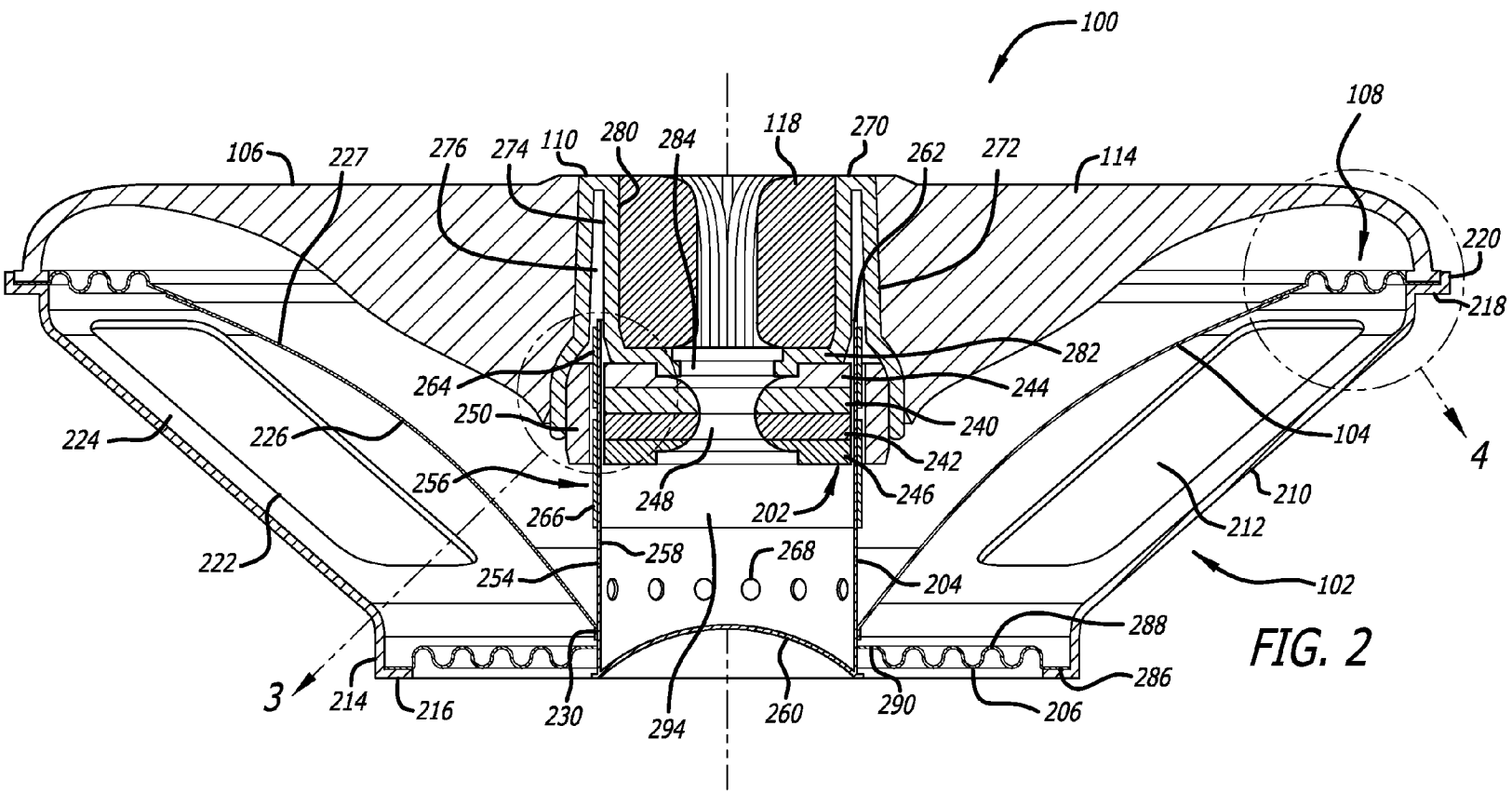
FIG. 2 is a cross-sectional elevation view of the transducer of FIG. 1.

FIG. 2 illustrates a cross sectional elevation view of loudspeaker 100. As shown, the rear frame 102 may include a conical construction having a frame body 210 defining an open interior 212, an annular base 214 having a bottom landing 216, a top landing 218, and a top rim 220. The frame 102 may generally be constructed from pressed sheet metal, molded from plastic or cast metal such as aluminum or steel, or other material known in the art for use with loudspeaker frames. One or more cut-outs 222 may be formed in the frame body 102 to define a series of struts 224 extending between the top landing 218 and the base 214.

The diaphragm 104, while it may be of any shape, is shown as having a generally conical body 226 having an exterior surface 227, a first end 410 (FIG. 4) attached to an interior flange 406 (FIG. 4) of the surround 108, and a second end 230 attached to the voice coil 204. As shown, the diaphragm 104 is positioned within the rear frame interior 212. In this configuration, the first end 410 is attached to the interior flange 406 of the surround 108 and the second end 230 is attached to the voice coil 204 by conventional adhesives or other mechanisms known in the art for mounting the diaphragm to the surround and the voice coil, respectively. The diaphragm 104 may be made from various materials including paper, polymer, metal based compositions, or material known in the art for use with diaphragms.

In the present example, the magnet assembly 202 includes a first magnet 240 and a second magnet 242 coupled between two pole plates: a front pole plate 244 and a rear pole plate 246. In other implementations, the magnet assembly 202 may simply include one, or three or more magnets. Persons skilled in the art will recognize that other configurations of the magnets 240, 242 and pole plates 244, 246 may be utilized without departing from the scope of the present disclosure.

The pole plates 244, 246 may be made of ferromagnetic steel or other suitable material with a high magnetic permeability. In the present example, the pole plates 244, 246 are constructed in an annular shape with a greater radius than height.

Sandwiched between the front 244 and rear 246 pole plates are the first and second magnets 240 and 242 that, together with the pole plates 244, 246, makes a stack, which may be held together by any number of methods, including mechanical fasteners or adhesives. In the present example, the magnets 240, 242 may be made of neodymium, a material that has a high magnetic flux per mass, but could alternatively be constructed of any number of available permanent magnet materials. The magnets 240, 242 may include a construction that complements the construction of the pole plates 244, 246, for example, as shown, the magnets 240, 242 may be annular with an outer radius slightly smaller than that of the front and rear pole plates 244, 246. By using neodymium, the magnet 240, 242 may be much thinner and smaller in diameter than a conventional magnet made of ceramic and thinner and smaller than a magnet made of alnico.

As shown, the pole plates 244, 246 and the magnets 240, 242 define a contoured port 248 that, when the pole plates 244, 246 and magnets 240, 242 are stacked, extends through the center of the magnet assembly 202. In other implementations, the port 248 may comprise a simple cylindrical shape.

The port 248 in the center of the magnets provides a path for the sound energy which is created by the vibration of dust-cap 260 to combine with the sound energy created by the diaphragm 104, serving to increase the overall radiating area and corresponding acoustic efficiency of the system. The port 248 provides a further benefit in higher velocity airflow through the relatively small port, which can be beneficial for self-cooling of the device as high-speed air flows past the hottest components in the vicinity of the port.

Figure 3:
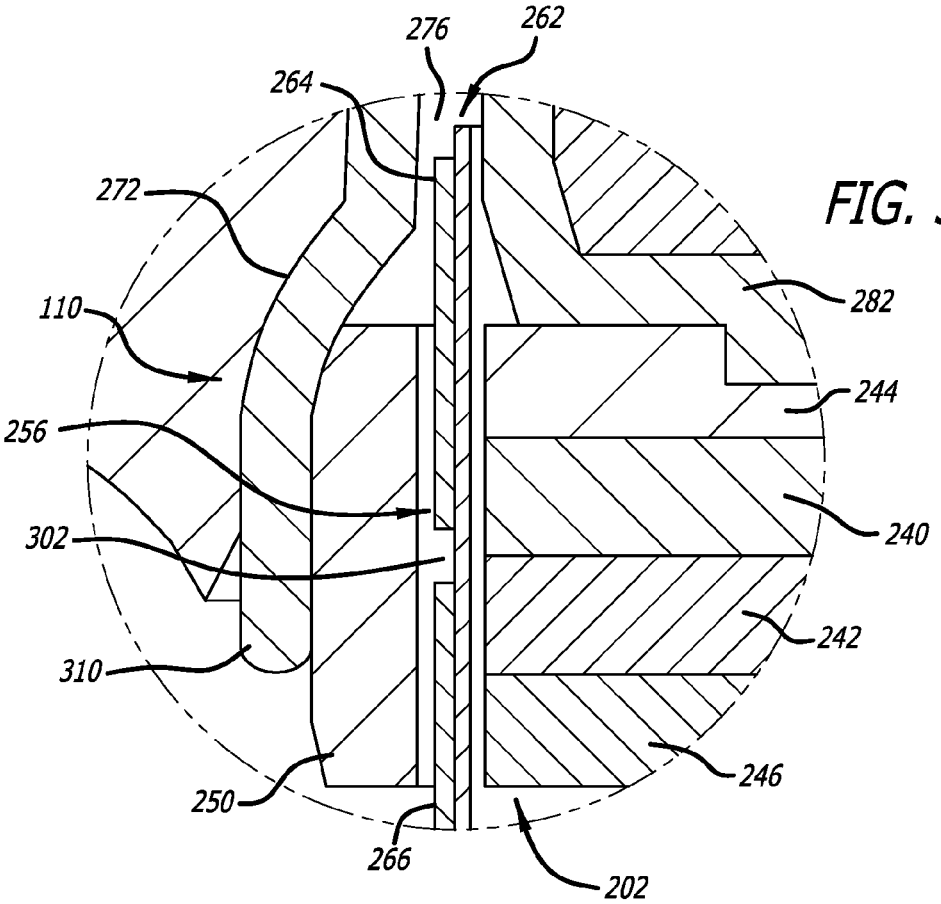
FIG. 3 is an exploded cross-sectional view of the magnet assembly of the transducer of FIG. 1.

FIG. 3 is an exploded cross-sectional view of the magnet assembly 202 of transducer 100. As shown, the magnet assembly 202 may be positioned within an annular gap sleeve 250. The annular gap sleeve 250 is coupled to and secured in place at an end 310 of the outer wall 272 of the center hub 110. Like the pole plates 244, 246 the gap sleeve 250 must be made of ferromagnetic steel. As shown in this implementation, the gap sleeve 250 comprises an annular construction having a height approximately equal to the combined heights of the pole plates 244, 246 and magnets 240,242, although the length of the gap sleeve may vary based on the specifics of the design. The magnet assembly 202 may be configured to fit within the gap sleeve 250 such that the inner radius of the gap sleeve 250 is slightly larger than the outer radius of the pole plates 244, 246. The slightly larger radius of the gap sleeve 250 provides an annular magnetic air gap 302 (FIG. 3) between the pole plate/magnet stack and the sleeve 250.

In some implementations, the exterior surfaces of the pole plates 244, 246 and the interior surface of the gap sleeve 250 may be coated with sheathing, coating, or plating (not shown) composed of an electrically conductive material such as, for example, copper (Cu), aluminum (Al), or the like. Such sheathing may be employed to reduce distortion and inductance in the transducer 100. In one example, the sheathing may have a thickness ranging from about 0.015 to 0.025 inches.

In other implementations, conductive shorting rings (not shown) may be used to reduce nonlinear distortion and the voice coil's inductance. Rather than being placed in the magnetic gap 302 like the copper sheathing, the conductive rings may be placed in front of the front plate 244, on the exterior surface of the magnets 240, 242 or pole plates 244, 246, and/or under the rear plate 246. In other implementations, one or more shorting rings may be incorporated into the inner wall of the annual gap sleeve 250. The conductive shorting rings may be made of copper, aluminum, or the like with radial thicknesses between, for example, 0.050 and 0.150 inches thick.

Returning now to FIG. 2, enclosing the magnet assembly 202, the voice coil 204 is positioned within the magnetic gap 302. The voice coil may generally be any component that oscillates in response to electrical current while being subjected to the constant magnetic field established by the magnetic assembly 202. In the illustrated example, the voice coil 204 includes a former 254 which may be wound with voice coil wire 256 within the magnetic gap 302. In alternative embodiments, the voice coil 204 may be wound with any known method used for making loudspeaker voice coils, such as former-less voice coils which consist of self-supporting coiled wire directly bonded to the diaphragm.

The coil former 254 generally includes a hollow cylinder body 258 which is closed off by a concave element 260, called a "dust cap." The former 254 also includes an open end 262 extending into the magnetic gap 302 in the front frame 106. The former 254 may be made of a stiff high temperature resistant material, such as polyamide, with a thickness of about 5/1000 of an inch, or any other suitable thickness. Besides keeping out dust, the dust cap 260 also is an intrinsic portion of the radiating area.

The voice coil 204 is mechanically referenced to, or communicates with, the diaphragm 104 by any suitable means that enables the voice coil 204 to consequently actuate or drive the diaphragm 104 in an oscillating manner, thus producing mechanical sound energy correlating to the electrical signals transmitted through the voice coil 204. In the illustrated example, the voice coil 204 mechanically communicates with the diaphragm 104 through a coil support structure or member such as a coil former 254.

The coil former 254 functions to support the coil wire 256. The diameter of the coil former 254 is greater than the outside diameter of the magnet assembly 202 and less than the inside diameter of the annular gap sleeve 250, enabling the coil former 254 in practice to extend into, and be free to move axially through, the gap 302 between the magnet assembly 202 and annular gap sleeve 250. At least a portion of the coil wire 256 is wound or wrapped on the outer surface of coil former 254 and may be securely attached to the coil former 254 such as by an adhesive. The coil wire 256 may be positioned on the coil former 254 such that at any given time during operation of the loudspeaker 100, at least a portion of the coil wire 256 is disposed in the gap 302. With this configuration, in operation the coil former 254 oscillates with the coil wire 256 and the oscillations are translated to the diaphragm 104.

The vibration of the dust cap 260 may be used to pump air through the port 248, past the heat sink fins 118 in the center hub 110 to provide efficient forced air cooling to the transducer 100 motor. This forced-air cooling also increases the transducer 100 motor efficiency since the radiating area of the dust cap is utilized.

The voice coil wire 256 may be wound about the cylinder body 258 at the open end 262 and include a single or dual coil. In the example shown, the voice coil 256 includes "dual-coil drive" or "dual-coil motor" configuration. This configuration includes a plurality of distinct coil portions, such that the coil 256 in effect constitutes a plurality of individual coils.

In the present example, the wire of the coil 256 is wound around the coil former 254 for a desired number of turns to form a first (upper or front) coil portion 264, then runs down the side of the coil former 254 for an axial distance, and then is wound around the coil former 254 for a desired number of turns to form a second (lower or rear) coil portion 266 that is axially spaced from the front portion 264. The portion of the wire extending between the front portion 264 and the rear portion 266 may be insulated to electrically isolate this portion of the wire from the two coil portions 264 and 266. The two ends of the wire may be connected to any suitable circuitry (including, for example, an amplifier) for driving the loudspeaker 100. The front portion 264 and the second coil portion 266 may be positioned on the coil former 254 such that at any given time during operation of the transducer 100, at least a portion of the front portion 254 and at least a portion of the rear portion 266 are disposed in the gap 302. Moreover, the front portion 254 may be positioned such that it is generally aligned with (i.e., adjacent to) the front pole plate 244, and the rear portion 266 may be positioned such that it is generally aligned with (i.e., adjacent to) the rear pole plate 246.

The preferred number of times that the coil wire 256 is wrapped around the former 254 is determined by the design of the loudspeaker and is well known to the art. In a case where the front portion 264 has the same number of turns (windings) as the rear portion 266, the number of turns is doubled in comparison to a single-coil configuration having the same number of turns of either individual coil portion 264 or 266. In addition, the surface area covered by the coil 306 having two coil portions 264 and 266 is also doubled without increasing the size of the magnetic gap 302. The wire forming the coil 306 may be run in a clockwise direction about one of the coil portions 264 or 266 and in a counterclockwise direction about the other coil portion 266 or 264. By this configuration, the electrical current runs through one of the coil portions 264 or 266 in a direction opposite to the electrical current running through the other coil portion 266 or 264. Because the magnetic flux lines established by the magnetic assembly 202 run in opposite directions in each of the first gap 352 and second gap 354 and the current in each coil portion 264 and 266 runs in opposite directions, Laplace law holds that the force created by the current in each coil portion 264 and 266 runs in the same direction, thus doubling the force imparted to the coil former 344 and enabling the transducer 100 to generate more power in comparison to a single-coil loudspeaker.

Generally, in operation the transducer 100 receives an input of electrical signals at an appropriate connection to the coil 204, and converts the electrical signals into acoustic signals according to mechanisms briefly summarized above in this disclosure and readily appreciated by persons skilled in the art. The acoustic signals propagate or radiate from the vibrating diaphragm 104 to the ambient environment. In this way, the vibrating diaphragm 104 establishes air flow in the interior space of the transducer 100, including in the medial interior region 294 between the dust cap 260 and the magnetic assembly 202. The downward axial movement of the diaphragm 104 draws ambient air into the medial region 294, and the upward axial movement of the diaphragm 104 pushes air upward through port 248, past the cooling fins 118, and outwards to the ambient environment. Thus, heated air passed through the port 248 from the medial region 294 may be dissipated by the fins 118 by convection.

In some implementations, the former 204 may further include one or more vents 268 radially arranged about cylinder body 258 for allowing the sound energy generated by the dust cap 260 to combine with the sound energy created by the diaphragm 104. In implementations where such vents 268 are used, the vents may be used in addition to, or in place of, the port 248 through the center of the magnets 240, 242.

In other implementations, the voice coil 204 may include a wrapper (not shown) that encases the voice coil former 254 to provide additional structural strength. Thus, when reference is made to connecting or attaching the suspension members or any other speaker component to the voice coil former 254, the attachment may be made either directly to the wrapper of the voice coil former 254 or directly to the voice coil former 254 when the former is absent a wrapper.

The voice coil 204 may generally be supported by the suspension system, namely, the spider 206 at the closed end 260. The spider 206 is attached to the cylinder body 258 by an adhesive or other mechanism known in the art for mounting the spider 206 to the voice coil former 254. In addition to the spider 206, the cylinder 258 may also be attached to one end of the diaphragm 104 at the closed end 260.

Referring back to FIG. 1, the front frame 106 encloses the interior 212 (FIG. 2) and generally includes a "wheel" configuration having a hub 110, an annular outer rim 112, and a plurality of radially arranged spokes 114 coupled between the hub 110 and the outer rim 112. The front frame 106 may be made from pressed metal, aluminum, cast or forged steel, plastic, ceramic, or any other suitable material. Because the front frame 106 acts as the primary heat-sinking component, it benefits from the use of material with high thermal conductivity, such as metal. If desired, the front frame 106 may be made from multiple materials that comprise different parts of the front frame as a compromise between cost, mechanical properties, and thermal properties, as determined by the specific use of the transducer.

Figure 5:
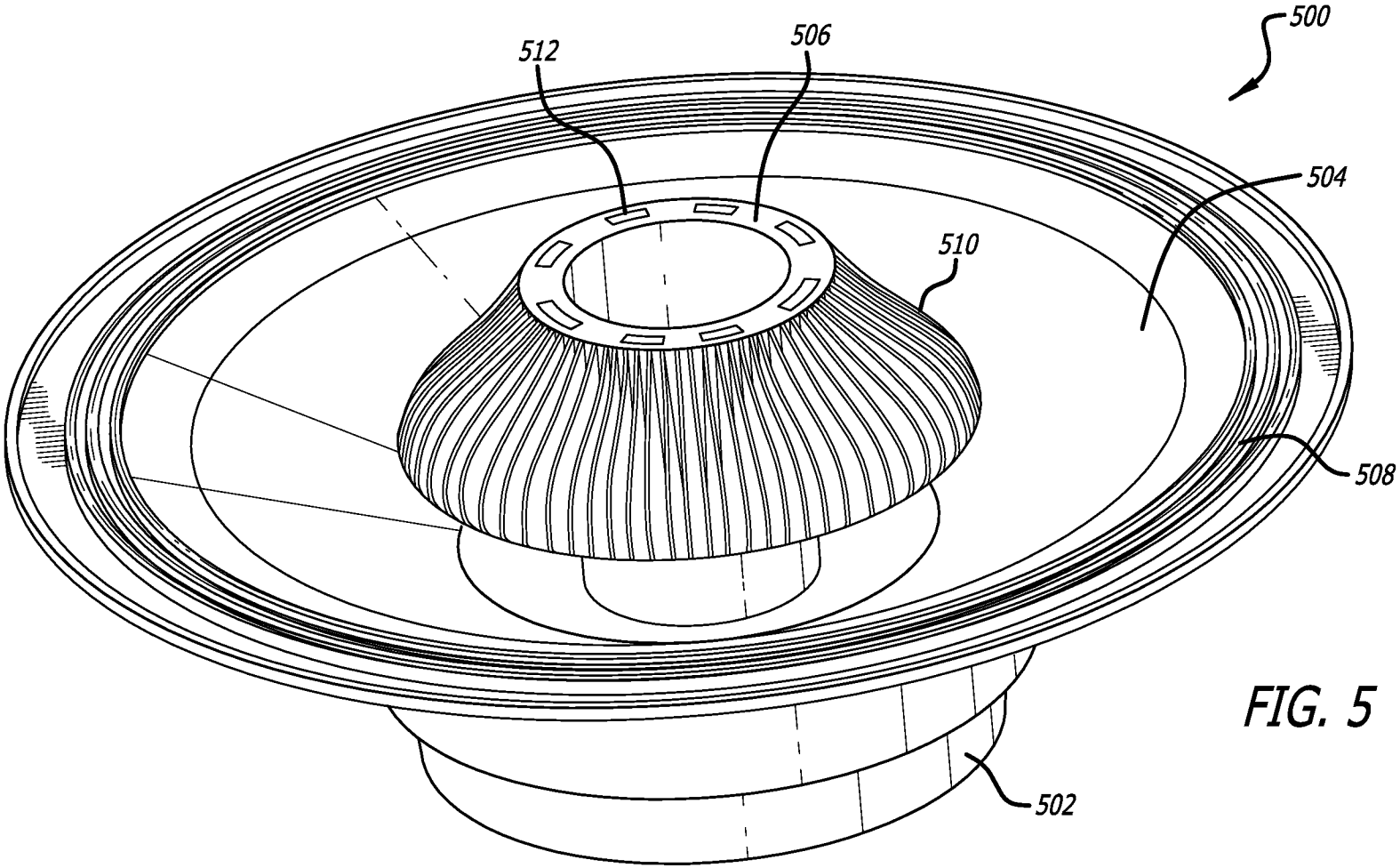
FIG. 5 illustrates a perspective view of an example of another implementation of a transducer of the present disclosure.

As best shown in FIG. 2, the hub 110 may include a hollowed cylindrical body 270 having an outer wall 272, an inner wall 274, and an annular interior 276 formed between the inner 274 and outer 272 walls. The inner wall 274 defines a center bore 280 for lightweighting. The center bore 280 may be optionally formed to facilitate the use of additional heat-sinking features such as cooling fins (118, 510) or ribs, as discussed in more detail below. For example, Cooling fins 510, shown in FIG. 5, are located on the exterior rather than the interior of the hub 110 because, in the implementation shown in FIG. 5, there is greater air flow along the outer surface of the hub caused by vibrating diaphragm 504. The annular interior 276 includes an open end 310 (see FIG. 3) for receiving at least a portion of the voice coil open end 262.

The cylindrical body 270 may also include an annular flange 282 coupled to an end of the inner wall 274. The annular flange 282 encloses one end of the center bore 280 and defines an orifice 284 that communicates the center bore 280 with port 248. The annular flange 282 is further configured to support the front pole plate 244 of the magnet assembly 202 by an adhesive or other suitable means.

In some implementations, as shown in FIGS. 1 and 2, a series of radially arranged cooling fins 118 may be coupled to the inner wall 274 of the hub 110. In one implementation, the cooling fins 118 may extend inwards into the center bore 280. The cooling fins 118 may be made from the same material used to make the front frame 106, or may be optionally constructed from a highly thermally conductive material if other portions of the front frame 106 are made of less thermally conductive materials. The purpose of the fins 118 is to interact with the airflow moving in and out of port 248 to more effectively provide self-cooling to the unit by convection. The specific shape, size, position, and density of the fins may be determined by the designer to provide the best balance of cooling while not excessively restricting airflow through the port 248.

Referring now to the outer wall 272 of the hub 110, the outer wall 272 may be angled or otherwise configured near open end 310 to accommodate the gap sleeve 250. As mentioned above, the gap sleeve 250 may be coupled to the inner surface of the outer wall 272 at open end 310 by an adhesive, press fit, or other means.

Moving outward from the hub 110, the outer rim 112 is configured to mate with the inner surfaces of the top landing 218 and rim 220 (FIG. 2). Referring now to FIG. 2, the outer rim 112 may be detachably coupled to the top landing 218 by one or more fasteners (not shown) via fastener holes 116 (FIG. 1) diametrically arranged about the rim 112.

Figure 4:
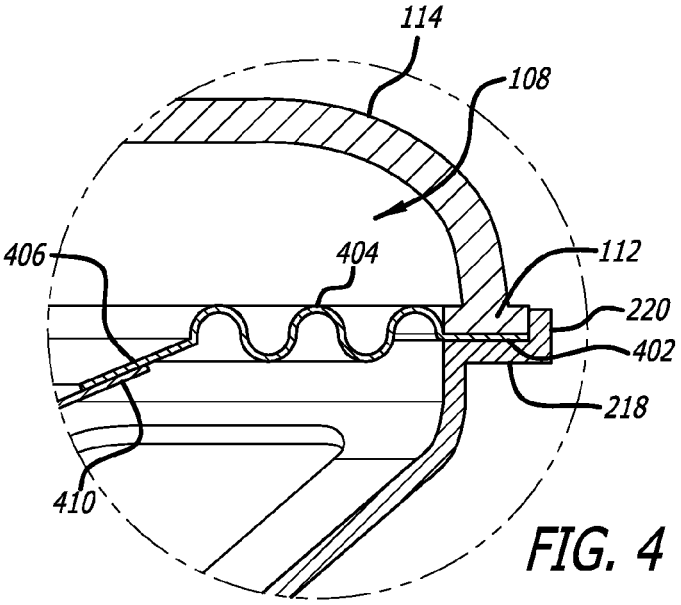
FIG. 4 is an exploded cross-sectional view illustrating the surround suspension member of the transducer of FIG. 1.

FIG. 4 is an enlarged sectional view of the surround suspension member 108. As shown, the surround 108 includes an outer edge 402 fastened between the outer rim 112 and the top landing 218, an undulation portion 304, and a downwardly and inwardly directed inner flap 406 which overlies and is attached to an outer end 228 of the diaphragm 104. The surround may be made of materials commonly known in the industry, including, for example, rubber, compressed foam rubber, corrugated cloth, paper, plastic, treated fabrics, or other suitable material that functions to constrain the diaphragm radially yet allow it to vibrate in an axial direction when driven by the voice coil 204. The particular method shown in this implementation of attaching the front and rear frame with the surround flange in between is only one possible method of construction, shown for illustration only. Other methods of attaching both frames together, such as ultrasonic welding, press fits, clamps, and other suitable means may be used as desired by the designer.

The surround suspension member 108 couples the rear 102 and front 106 frames to the diaphragm 104 and is configured and arranged to provide a degree of constraint to the maximum excursions of the voice coil/diaphragm assembly in both the inward and upward directions, and keep the voice coil 204 centered with the magnetic gap 302. While the current configuration shows the suspension member having a series of concentric corrugations, the present disclosure could be practiced utilizing other known suspension configurations including half roll shape, triangular corrugations, flat surround, or even no surround at all (where all the restoring force comes from the spider alone).

Referring back to FIG. 2, the spider 206 includes an outer flange 286, an undulation portion 288, and an attachment portion 290. In the illustrated example, the outer flange 286 may be attached to the bottom landing 216 of the annular base 214, and the attachment portion 290 may be attached to the cylindrical body 258 of the voice coil 204 by adhesive or other means suitable for attaching suspension members to the voice coil. The spider may be made of a variety of materials such as phenolic-impregnated cloth, rubber, plastics, textiles, or other material known in the art for surround suspension members.

Generally, the spider 206 connects the voice coil 204 to the annular base 214 of the rear frame 102. Thus, the spider 206 assists in centering the voice coil 204 in the magnetic gap 302, about the magnet assembly 202.

During operation, the transducer 100 of the present implementation produces sound waves when the voice coil 204 is energized by an electric current which is transmitted via flexible wires known as tinsel leads (not shown). Other methods of energizing the voice coil may also be used, such as inductive coupling.

Further, the ability of the front frame 106 to dissipate heat generated by the voice coil 204 makes the transducer more powerful. Without the heat sink of the front frame 106, doubling in dissipation capability, for example, the power in the transducer 100 would about double the temperature generated. Unless the transducer 100 was underpowered originally, doubling the temperature would damage the components of the transducer 100 and cause the transducer 100 to stop working. Thus, increasing power in the transducer 100 requires a technique to dissipate heat.

One technique utilized by the present disclosure to manage heat is the dual coil winding of the coil wire 256. By winding the wire 256 at two different places with twice the surface area on the former 254, the magnet assembly 202, and the annular gap sleeve 250, heat can pass to different places and over a larger area. By passing in different areas and over a larger area, heat can dissipate faster, provided that heat can flow from the gap sleeve 250 and magnet assembly 202. However, without providing for the release of heat from the gap sleeve 250 and magnet assembly 202, the design advantages of the double coil would be compromised.

To allow heat to flow from the gap sleeve 250 and the magnet assembly 202, the front frame 106 is coupled to the gap sleeve 250 and the magnet assembly 202 at the central hub 110. The front frame 106 then acts as a heat sink into which heat from the gap sleeve 250 and magnet assembly 202 can flow. Heat that flows through the front frame 106 is dissipated by the housing because of its greater surface area.

As best seen in FIGS. 1 and 2, the surface area of the front frame 106 is increased by adding radial or other high surface area fins (i.e. spokes 114) extending from the hub 110. Best noted in FIGS. 2 and 3, the outer wall 272 of the central hub 110 is concentric with the annular gap sleeve 250 and is in engagement with a substantial portion of the exterior surface of the sleeve. In the same way, the inner wall 274 of the central hub 110 is bonded to the front pole plate 244 of the magnet assembly 202. Also seen in FIG. 1, the cross-sectional area of the hub 110 is substantial with respect to the thickness of the gap sleeve 250, permitting the front frame 106 to act as an effective heat sink. The fins or spokes 114 are integrally formed with the hub 110, i.e., the portion of the front frame 106 which is in engagement with the gap sleeve and magnet assembly 202.

The spokes 114 enable a certain size front frame housing 106 to have a substantially greater surface area than a similarly sized housing with a regular or compact shape. Spokes 114 of any shape may be used to increase the surface area of the front frame 106. Additionally, other surface irregularities or protrusions, such as the radial wing portion 119 extending from the outward ends of the spokes 114, may be used to increase the surface area of the front frame. Because heat flows to the air from the surface of the front frame 106, the larger the surface area of the front frame 106, the greater the heat dissipation.

Additionally, more heat can be dissipated by blowing or passing hot air through the central hub 110 of the front frame housing 106. Because the heat flows from the front frame 106 to the ambient air, the flow of air quickens the dissipation of heat from the front frame 106.

In the implementation show in FIGS. 1-4, air flow through the central hub 110 is generated by the vibration of the diaphragm 104 as the transducer 100 produces sound. Air flow is pushed from the medial interior region 294 through port 248. The air passing from port 248 then moves past the cooling fins 118 and the movement of air over the fins 118 increases their ability to dissipate heat into the ambient air.

FIG. 5 illustrates a perspective view of another example of an implementation of a transducer 500 of the present disclosure. The transducer 500 may include a basket or rear frame 502, a diaphragm 504, a magnet assembly 602 (FIG. 6), a voice coil 604 (FIG. 6), a center hub 506, and a suspension system including a surround 508 and a spider connector 606 (FIG. 6).

The implementation shown in FIGS. 4 and 5 may not be as desirable as the implementation shown in FIG. 2 because the latter is able to use the sound energy radiated by the dust cap, this increasing the overall efficiency of the transducer. However, the implementation shown in FIG. 5 has the advantage of lighter in weight because the front frame is removed from the design and the heatsink "hub" is supported by pedestal 630 (FIG. 6) incorporated into the rear frame 502.

Figure 6:
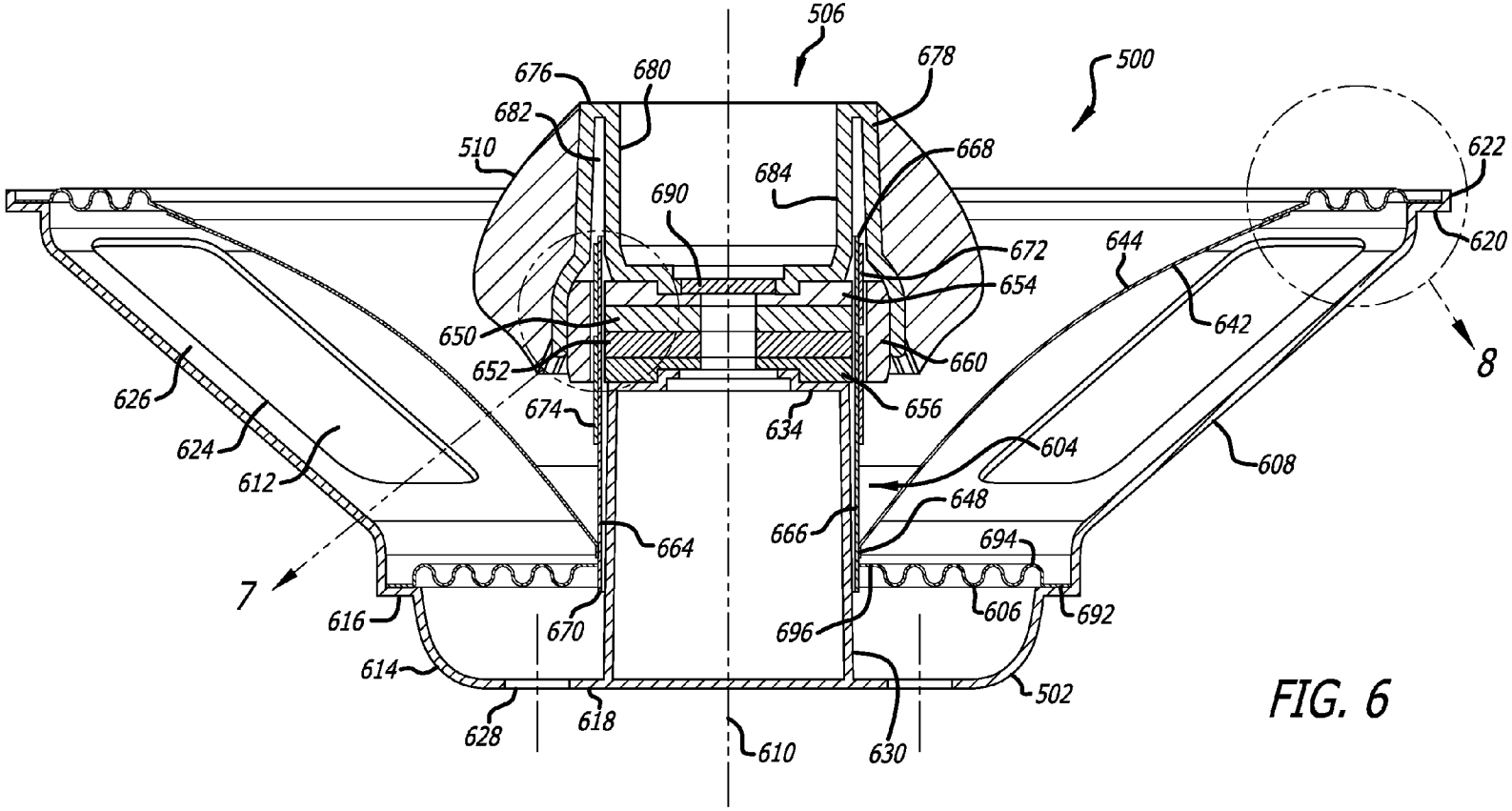
FIG. 6 is a cross-sectional elevation view of the transducer of FIG. 4.

FIG. 6 illustrates a cross sectional elevation view of transducer 500. As shown, the rear frame 502 may include a conical construction or other shape having a frame body 608 defining an open interior 612, an annular base 614 having a landing 616 and rounded bottom wall 618, a top landing 620, and a top rim 622. One or more cut-outs 624 may be formed in the frame body 608 to define a series of struts 626 extending between the top landing 620 and the base 614. Further, for purposes of saving weight or reducing the backpressure on the diaphragm, in some implementations the bottom wall 618 may include one or more vent holes 628, as needed.

In some implementations, as shown in FIG. 6, the rear frame 502 may also include a pedestal 630 axially extending from the bottom wall 618 into the frame interior 612. The pedestal 630 includes an annular sidewall 632 and a top wall 634.

The diaphragm 504 may include a generally conical body 642 having an exterior surface 644, a first end 646 attached to surround 508, and a second end 648 attached to the voice coil 604. As shown, the diaphragm 504 is positioned within the rear frame interior 612.

Similar to the example above, the magnet assembly 602 of the present example includes a first magnet 650 and a second magnet 652 coupled between front pole plate 654 and rear pole plate 656. However, in other implementations, the magnet assembly 602 may simply include one, or three or more magnets.

Figure 7:
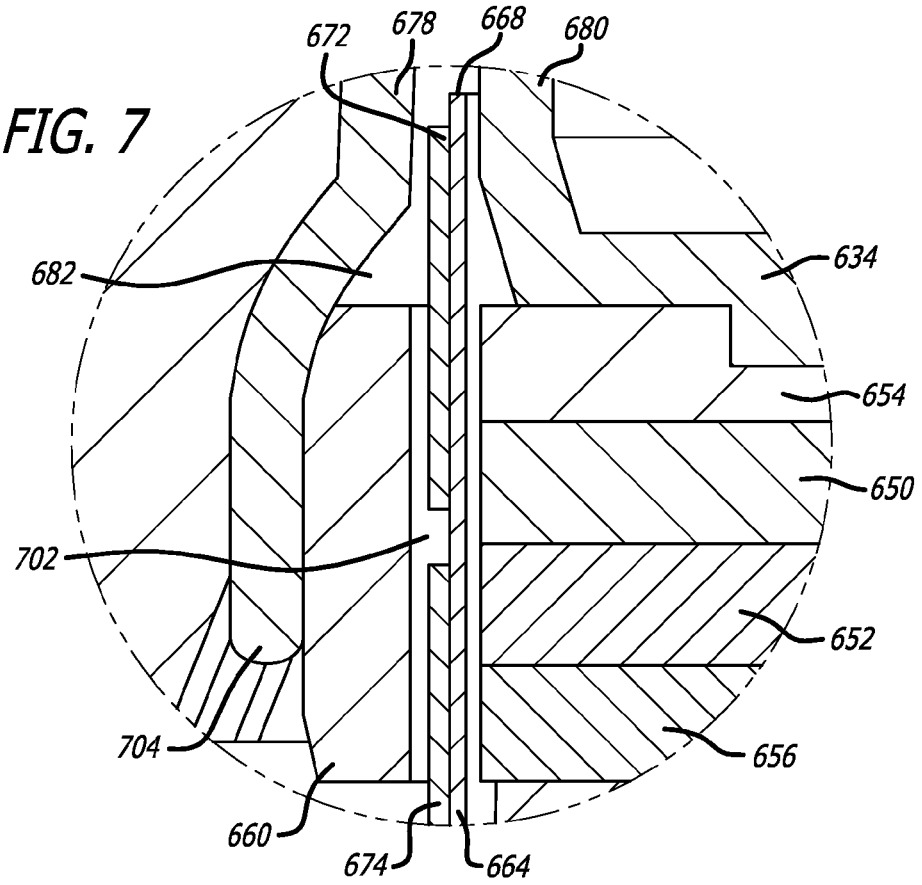
FIG. 7 is an exploded cross-sectional view of the magnet assembly of the transducer of FIG. 4.

The magnets 650, 652 may include a construction that complements the construction of the pole plates 654, 656. As shown in FIG. 7, the magnet assembly 602 is positioned within annular gap sleeve 660. The annular gap sleeve 660 may be coupled to a central portion of the center hub 506 to secure the sleeve in position relative to the magnet assembly. Similar to the implementation described above, the magnet assembly 602 may be configured to fit within the gap sleeve 660 such that the inner radius of the gap sleeve 660 is slightly larger than the outer radius of the pole plates 650, 652. The slightly larger radius of the gap sleeve 660 provides an annular magnetic air gap 702 between the pole plate/magnet stack 602 and sleeve 660.

Enclosing the magnet assembly 602, the voice coil 604 is positioned within the magnetic gap 702. The voice coil 604 includes a former 664 having a cylinder body 666 with an open end 668 coupled to the spider 606, and an opposite open end 670 extending into the magnetic gap 702 in the center hub 506.

The voice coil 604 may include a dual coil having a front portion 672 and a rear portion 674. The wire in the front portion 672 is wrapped around the former 664 such that it corresponds with the front pole plate 654. Similarly, the wire in the rear portion 674 is wrapped around the former 664 such that it corresponds with the rear pole plate 656. In other implementations, the voice coil 604 may include two or more windings. Additional windings may be positioned in additional magnetic gaps to serve as driving coils, or between gaps to serve as braking coils which limit extreme excursions or for other purposes.

The voice coil 604 may generally be supported by the suspension system, namely, the spider 606 at open end 668. The spider 606 is attached to the cylinder body 666 by an adhesive or other mechanism known in the art for mounting the spider 606 to the voice coil former 664. In addition to the spider 606, the cylinder 666 may also be attached to one end of the diaphragm 504 at open end 668.

As best shown in FIG. 6, the hub 506 may include a hollowed cylindrical body 676 having an outer wall 678, an inner wall 680, and an annular interior 682 formed between the inner 680 and outer 678 walls. The center hub 506 may be made from pressed metal, aluminum, cast or forged steel, plastic, ceramic, or any other suitable material.

The inner wall 680 defines a center bore 684 that is closed at one end 690, to provide a savings in weight where material is not needed. The closed end 690 is configured to support the front pole plate 654 of the magnet assembly 508 by an adhesive, epoxy, or other suitable means. The annular interior 682 includes an open end 704 for receiving at least a portion of the voice coil open end 670.

In some implementations, as shown in FIGS. 5 and 6, a series of radially arranged cooling fins 510 may be coupled to or integrally formed with the outer wall 678 of the hub central 506. As shown, the cooling fins 410 may extend outwards from the outer wall 678 to provide increased surface area for hub 506, which acts as a heat sink. Thus, the cooling fins 510 allow the heat generated by the voice coil to be more efficiency removed from the structure. The cooling fins 410 may be made from any material with a high thermal conductivity, such as metal. For the implementation shown in FIGS. 4 and 5, exterior fins rather than interior fins would be more useful to take advantage of the moving air created by the vibrating diaphragm, although additional fins could be placed on the inside of the hub 506 as well. In addition to cooling fins, the central hub may include one or more cooling vents 512 for ventilating hot air trapped in the interior of the basket or rear frame 502.

Referring now to the outer wall 678 of the hub 506, the outer wall 678 may be angled or otherwise configured near open end 704 to accommodate the gap sleeve 660. As mentioned above, the gap sleeve 660 may be coupled to the inner surface of the outer wall 678 at open end 704 by an adhesive, press fit, or other means.

Returning to the magnet assembly 602, in the implementation shown, the front pole plate 654 includes seat 655 and the rear pole plate includes seat 657. The seats 655, 657 are configured to complement and mate with the annular flange 688 of the center hub 506 and the top surface of the nipple portion 630, respectively. Thus, when assembled, the magnet assembly 602 rests on, is coupled to, and centered about the frame centerline 610 by the nipple portion 630. In the same way, the center hub 506 rests on, is coupled to, and centered about the frame centerline 610 by the magnet assembly 602. Therefore, the pedestal 630 serves to both support and center the magnet assembly 602 and the center hub 506. The magnet assembly 602 may be coupled between the pedestal 630 and the center hub 506 by adhesive or other suitable means.

Moving down to the base 614, the spider 606 includes an outer flange 692, an undulation portion 694, and an attachment portion 696. In the illustrated example, the outer flange 692 may be attached to the bottom landing 616 of the annular base 614, and the attachment portion 696 may be attached to the cylindrical body 666 of the voice coil 604 by adhesive or other means suitable for attaching suspension members to a voice coil.

Figure 8:
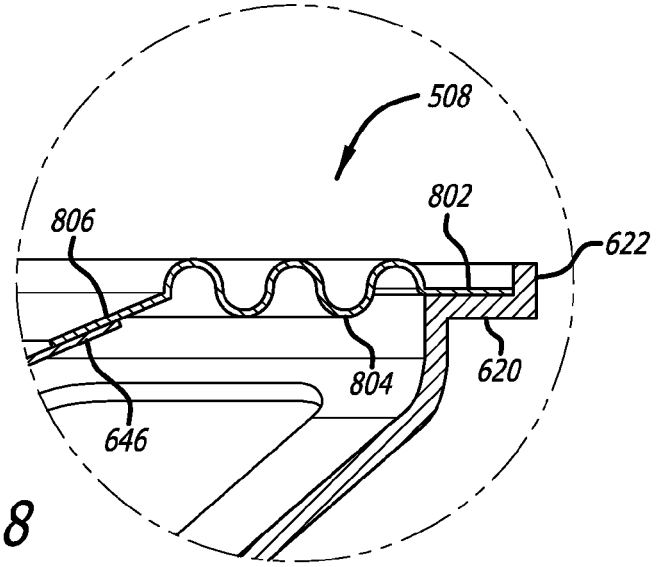
FIG. 8 is an exploded cross-sectional view illustrating the surround suspension member of the transducer of FIG. 4.

FIG. 8 is an enlarged sectional view of the surround suspension member 508. As shown, the surround 508 includes an outer edge 802 attached to the top landing 620, an undulation portion 804, and a downwardly and inwardly directed inner flap 806 which overlies and is attached to an outer end 646 of the diaphragm 504 (see FIG. 5). The outer edge 802 of the surround 508 may be attached to the top landing 620 by adhesive or other means suitable for attaching suspension members to a speaker frame.

Figure 9:
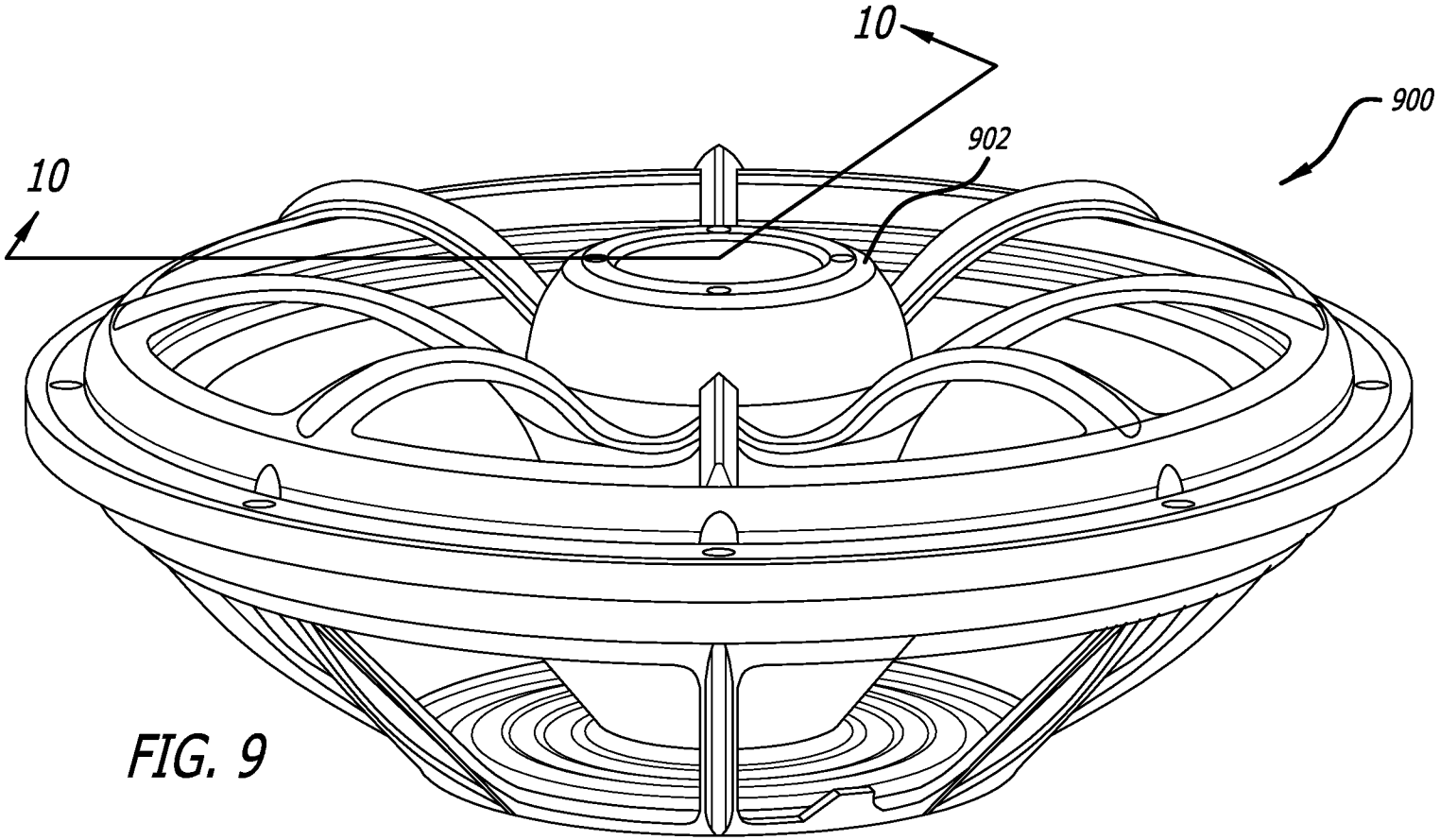
FIG. 9 illustrates a perspective view of an example of yet another implementation of a transducer of the present disclosure.
Figure 10:
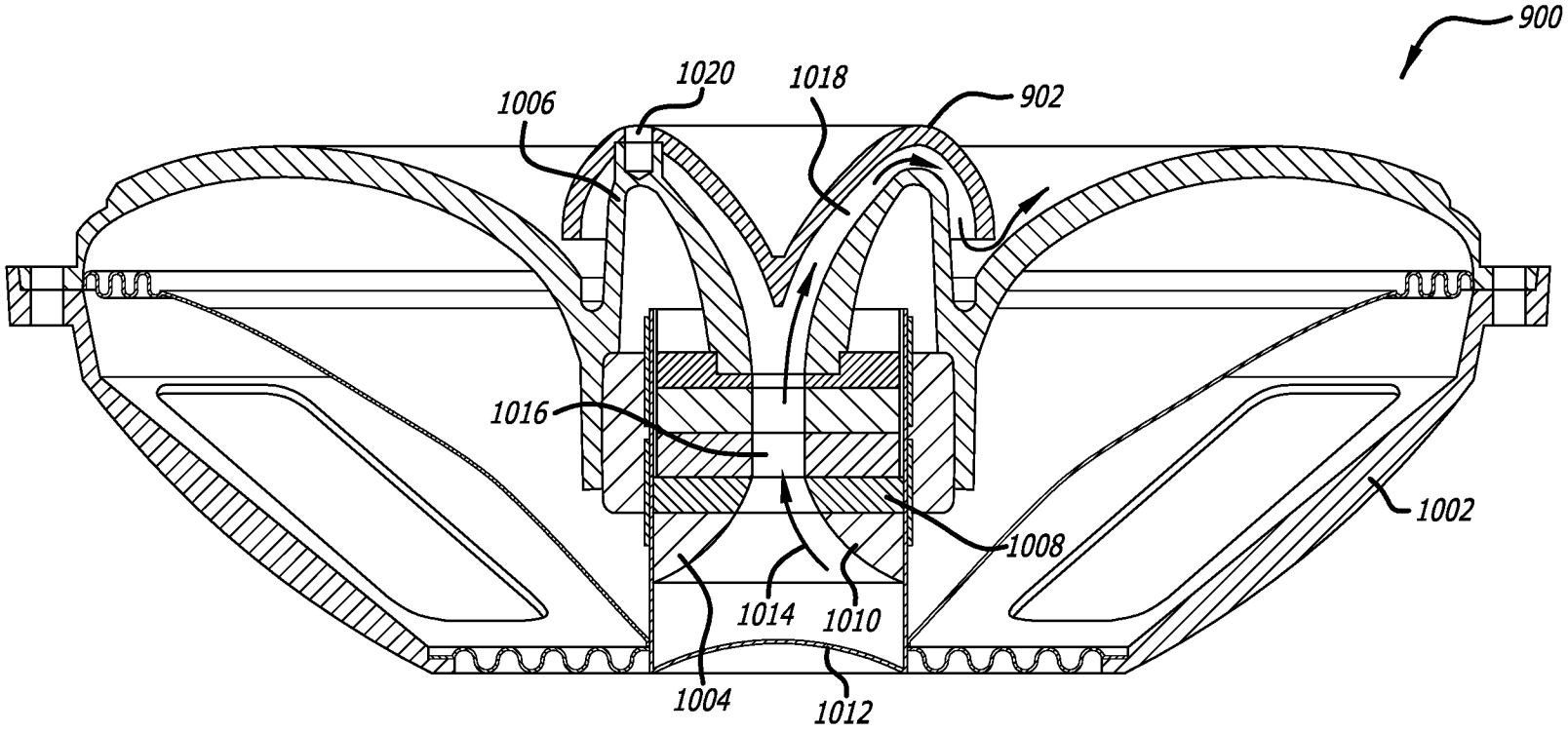
FIG. 10 is a cross-sectional view of the transducer of FIG. 9 taken along section line 10-10.

FIGS. 9 and 10 are perspective and cross sectional views of yet another example of an implementation of a transducer 900 of the present disclosure. As best shown in FIG. 10, the transducer 900 includes a rear frame 1002, a flared air expander intake element 1004, a front frame 1006, and a magnetic motor assembly 1008 coupled between the air expander 1004 and the front frame 1006. The air expander 1004 includes a contoured nozzle 1010 for passing air trapped between dust cap 1012 and the motor assembly 1008. This air flow, depicted as arrows 1014, is passed from the nozzle 1010 through an orifice 1016 formed in the center of the motor assembly, to a curved outtake passage 1018 formed between the front frame 1006 and end cap 1020 mounted on the top of the front frame 1006 by fasteners.

The present implementation provides, but is not limited to, an inverted loudspeaker configuration with improved performance due to lower air distortion. In particular, the improved performance is attributed to the implementation of the gradual expansion of the orifice 1016 formed in the motor assembly 1008 that provides laminar air flow through the orifice. The orifice 1016 is necessary to decrease the stiffness of the air volume 1022 between the dust cap 1012 and the motor assembly 1008 that would otherwise produce a significant increase of the motor assembly's resonance frequency and increase of nonlinear distortion produced by the nonlinear compression of the air volume 1022 trapped between the dust cap and the motor. The distortion caused by the air turbulence of the air pumped through the orifice 1018 depend on the diameter of the orifice, as a larger hole is characterized by a smaller or complete lack of turbulent flow. However a large hole will decrease the amount of magnet necessary to provide required magnetic flux density in the magnetic gap.

The front frame 1006 has an expansion to reduce the velocity of the air flow 1014 exiting the orifice 1016 of the motor assembly 1008. The front frame 1006 may or may not include the end cap 1020 that defines the outtake passage 1018. In implementations that use the end cap 1020, the outtake passage 1018 formed by the end cap directs the air flow 1014 backwards to decrease the audibility of the distortion high-frequency components by preventing their direct front radiation, as shown in FIG. 10.

Transducers according to the present disclosure may provide various advantages. First, transducers of the present disclosure provide a lower profile thickness or height than prior art multiple-coil transducers. As discussed in the background section above, one drawback of multiple-coil transducers over single coil transducers is that multiple-coil transducers are deeper and require more space inside the enclosure. By inverting the magnetic motor assembly, (i.e., placing the magnetic motor in front of the diaphragm cone) a compact transducer construction is provided. By way of example, the depth of a 15" round speaker dual coil driver was reduced from an overall height of about 8.2 inches to about 5.5 inches by incorporating the principles of the present disclosure. This results in about a 33% reduction in depth over conventional duel coil drivers.

A second advantage provided by the present disclosure is enhanced thermal (cooling) performance. This is provided because the electromagnetic motor is mounted on the exterior of the transducer (i.e., above or upstream from the diaphragm) and, thus, exposed to ambient air, rather than being housed inside the loudspeaker enclosure where the air temperature may be significantly higher. In addition, the added surface area provided by the cooling fins may serve to enhance the cooling performance which is primarily a function of having the heat generating component (the voice coil) outside the speaker enclosure.

Further, dual coil drivers built with neodymium inside the coil are generally limited in power handling by overheating of the magnet, which can demagnetize if the safe operating temperature is exceeded. This heating problem is exacerbated when the driver is installed in an enclosure. By placing the magnetic motor outside of the enclosure, the power handling and cooling of the transducer will greatly increase. By ways of example, experiments conducted on transducers of the present disclosure reveal that an increase of about 50% in the power handling may be achieved.

Third, transducers of the present disclosure provide increased dynamic stability because placing the magnetic motor in front of the diaphragm creates a moving assembly (i.e., movement of the voice coil relative to the magnet assembly) with a better center of gravity and reduced rocking. In particular, the inverted motor topology places the center of mass of the moving components between the two suspensions, as compared with traditional dual coil transducers, such as the transducer disclosed in U.S. Pat. No. 5,748,760, where there is a long cantilevered mass consisting of the voice coil which is farther away from the suspension points.

While particular implementations of the present disclosure have been described herein as having circular construction, persons skilled in the art will appreciate that transducers according to the present disclosure may include an oval, square, polygon, or other suitable construction. While particular implementations of the present disclosure have been described herein as having a dual coil construction, persons skilled in the art will appreciate that transducers according to the present disclosure may include other multiple-coil constructions.

It can thus be seen that implementations provided in this disclosure may be useful in increasing the cooling of a conductive coil, magnet, and associated structures of an electromagnetic transducer such as the type utilized in or constituting a loudspeaker or other type of electro-acoustical transducer. The cooling is effected through the circulation of a heat transfer medium. The circulation is caused by operating the transducer in a normal manner, and the heat transfer medium is a fluid (e.g., air) normally existing in the transducer. No external or additional air moving means such as a fan or blower are required, although the subject matter of this disclosure encompasses implementations in which such air moving means may also be employed.

In one implementation of the present disclosure, the overall thickness of the loudspeaker construction may be between 4 to 8 inches in depth. These loudspeaker dimensions are given by way of example only. One skilled in the art will recognize that the above configuration can be incorporated into speaker systems of various sizes and shapes and is not limited to the dimension described above, but may vary based upon the desired application.

In general, terms such as "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used herein to indicate a structural, functional, mechanical, electrical, signal, optical, magnetic, electromagnetic, ionic or fluidic relationship between two or more components (or elements, features, or the like). As such, the fact that one component is said to couple to a second component is not intended to exclude the possibility that additional components may be present between, and/or operatively associated or engaged with, the first and second components.

Although the previous description only illustrates particular examples of various implementations, the present disclosure is not limited to the foregoing illustrative examples. A person skilled in the art is aware that the disclosure as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. An electromagnetic transducer comprising:

a voice coil disposed around a central region of the transducer, the voice coil including a former having a closed end cap;

a movable diaphragm extending generally outwardly from the central region and including an inner edge attached to the voice coil, where the diaphragm includes a concave surface; and at least one magnet assembly positioned forward of the concave surface and including at least one magnet, the at least one magnet assembly defining at least two magnetic gaps disposed about the central region, the at least one magnet assembly defining a port through the at least one magnet and disposed about a central axis of the transducer, wherein when an electrical signal is passed through the voice coil to generate electromagnetic forces that cause the voice coil and diaphragm to oscillate, the end cap pumps hot air within a space between the at least one magnet assembly and the end cap out of the space via the port to the ambient air.

2. The transducer of claim 1, where the voice coil is positioned within the at least two magnetic gaps, the voice coil being free to move axially within the at least two magnetic gaps.

3. The transducer of claim 1 further including at least one spider element coupled between a lower portion of the voice coil and a basket disposed about the central region of the transducer, where the at least one spider element is positioned aft of the concave surface.

4. The transducer of claim 1, where the voice coil includes a wire wound about a coil former to form at least a first coil and a second coil, the at least first coil and second coil being axially spaced from each other where the first coil is at least partially disposed in a first magnetic gap and the second coil is at least partially disposed in a second magnetic gap.

5. The transducer of claim 4, where the first coil and second coil increases the surface area of the wire on the former which increases the heat dissipation capability of the transducer.

6. The transducer of claim 1, where the at least one magnet assembly includes at least a first magnet and a second magnet stacked between a first pole plate and a second pole plate, the at least one magnet assembly being disposed within a gap sleeve coupled to a frame of the transducer.

7. The transducer of claim 6, where the spacing between the at least one magnet assembly and the gap sleeve at least partially define the at least two magnetic gaps.

8. The transducer of claim 1, where the at least one magnet assembly includes one or more shorting rings.

9. The transducer of claim 6, where the gap sleeve includes one or more shorting rings.

10. An electromagnetic transducer comprising:

a basket disposed about a central axis;

a diaphragm including a movable diaphragm portion reciprocatively moveable relative to the central axis, where the diaphragm is coupled to the basket to define an enclosure between a back surface of the diaphragm and the basket; and at least one magnet assembly disposed outside of the enclosure and axially spaced from the diaphragm, the at least one magnet assembly including at least one magnet and having at least a first and second magnetic gap annularly disposed about the central axis, the at least one magnet assembly defining a port through the at least one magnet and disposed about the central axis; and an electrically conductive coil mechanically communicating with the diaphragm, the coil including at least a first coil and a second coil axially spaced from each other where the first coil is at least partially disposed in the first magnetic gap and the second coil is at least partially disposed in the second magnetic gap, the coil including a former having a closed end cap, wherein when an electrical signal is passed through the coil to generate electromagnetic forces that cause the coil and diaphragm to oscillate, the end cap pumps hot air within a space between the at least one magnet assembly and the end cap out of the space via the port to the ambient air, and the port provides a path for sound energy created by oscillation of the end cap and diaphragm.

11. The transducer of claim 10, where the first coil and second coil increase the surface area of the conductive coil, which increases the heat dissipation capability of the transducer.

12. The transducer of claim 10, where the at least one magnet assembly includes at least a first magnet and a second magnet stacked between a first pole plate and a second pole plate, the at least one magnet assembly being disposed within a gap sleeve coupled to a frame of the transducer.

13. The transducer of claim 12, where the spacing between the at least one magnet assembly and the gap sleeve at least partially define the at least two magnetic gaps.

14. The transducer of claim 10, where the at least one magnet assembly includes one or more shorting rings.

15. The transducer of claim 12, where the gap sleeve includes one or more shorting rings.

16. An electromagnetic transducer comprising:

a center hub disposed about a central axis of the transducer;

at least one magnet assembly coupled to the center hub and including at least one magnet, the at least one magnet assembly defines at least two magnetic gaps annularly disposed about the central axis, wherein the at least one magnet assembly defines a port through the at least one magnet and disposed about the central axis;

a voice coil disposed about the at least one magnet assembly, the voice coil being positioned within the at least two magnetic gaps and including a former having a closed end cap; and a diaphragm extending generally outwardly from the center hub and including an inner edge attached to the voice coil, where the diaphragm is coupled with a basket disposed about the central axis, and where the basket forms an enclosure with the back surface of the diaphragm;

wherein at least one magnet assembly is disposed outside of the enclosure to enable heat dissipation from the at least one magnet assembly to the ambient air, where when an electrical signal is passed through the voice coil to generate electromagnetic forces that cause the voice coil and diaphragm to oscillate, the end cap pumps hot air within a space between the at least one magnet assembly and the end cap out of the space via the port to the ambient air.

17. The transducer of claim 16, where the basket is coupled to the center hub by at least one strut.

18. The transducer of claim 17, where the at least one strut acts as a heat sink for dissipating heat generated by the at least one magnet assembly.

19. The transducer of claim 16, wherein a diameter of the port is smaller than a diameter of the end cap.

20. The transducer of claim 16, where the center hub includes one or more fins for convection cooling hot air passing from the port.

21. The transducer of claim 16, where the center hub includes one or more fins for convection cooling heat generated by the at least one magnet assembly.

22. The transducer of claim 16, where the former may include one or more vents to allow sound energy generated by the oscillating end cap to combine with the sound energy generated by the oscillating diaphragm.

23. A method for cooling an electromagnetic transducer, comprising:

providing the transducer with at least one magnet assembly, the at least one magnet assembly including at least one magnet having a port formed through its center, a coil including at least a first coil and a second coil axially spaced from each other where the first coil is at least partially disposed in a first magnetic gap and the second coil is at least partially disposed in a second magnetic gap, and a former about which the coil is wound, where the former includes a closed end cap positioned below the at least one magnet assembly; and passing electrical signals through the first coil and second coil to cause the former to oscillate, wherein the end cap pumps hot air within a space between the at least one magnet assembly and the end cap through the port to the ambient air.

24. The method of claim 23 further comprising providing one or more fins to convection cool hot air passing from the port.

25. An electromagnetic transducer comprising:

at least one magnet assembly disposed around a central region of the transducer and including at least one magnet, the at least one magnet assembly defining a port through the at least one magnet and disposed within the central region;

a voice coil disposed about the at least one magnet assembly, where the voice coil and at least one magnet assembly define at least two magnetic gaps disposed about the central region, the voice coil including a former having a closed end cap;

at least one spider element coupled between a lower portion of the voice coil and a basket disposed about the central region of the transducer; and a moveable diaphragm extending generally outwardly from the central region and including an inner edge attached to the voice coil, where the diaphragm is positioned between the at least one magnet assembly and the at least one spider, wherein when an electrical signal is passed through the voice coil to generate electromagnetic forces that cause the voice coil and diaphragm to oscillate, the end cap pumps hot air within a space between the at least one magnet assembly and the end cap out of the space via the port to the ambient air.

26. The transducer of claim 25, wherein a diameter of the port is smaller than a diameter of the end cap.

* * * * *